US010082767B2

(12) United States Patent
Matsumura

(10) Patent No.: US 10,082,767 B2
(45) Date of Patent: Sep. 25, 2018

(54) AIR EXHAUSTS AND IMAGE FORMING APPARATUS COMPRISING THE SAME

(71) Applicant: CANON KABUSHIKI KAISHA, Tokyo (JP)

(72) Inventor: Takuya Matsumura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/585,522

(22) Filed: May 3, 2017

(65) Prior Publication Data

US 2017/0336757 A1 Nov. 23, 2017

(30) Foreign Application Priority Data

May 20, 2016 (JP) ..... 2016-101577

(51) Int. Cl.
*G03G 21/20* (2006.01)

(52) U.S. Cl.
CPC ..... *G03G 21/206* (2013.01); *G03G 21/20* (2013.01); *G03G 21/203* (2013.01); *G03G 2221/1645* (2013.01)

(58) Field of Classification Search
CPC .... G03G 21/206; G03G 21/20; G03G 21/203; G03G 2221/1645
See application file for complete search history.

(56) References Cited

U.S. PATENT DOCUMENTS 8,660,457 B2 2/2014 Ryuzaki
2011/0262175 A1* 10/2011 Takahashi ..... G03G 21/206 399/92
2012/0240534 A1* 9/2012 Ryuzaki ..... G03G 21/206 55/385.4

FOREIGN PATENT DOCUMENTS

JP 2013-003459 A 1/2013
JP 2015-158580 A 9/2015

OTHER PUBLICATIONS

Hiroyuki Takahashi et al., U.S. Appl. No. 15/623,901, filed Jun. 15, 2017.

* cited by examiner

*Primary Examiner* — Rodney Bonnette
(74) *Attorney, Agent, or Firm* — Fitzpatrick, Cella, Harper & Scinto

(57) ABSTRACT

An image forming apparatus includes an image forming portion, a housing, and a partition wall portion. The housing is configured to store the image forming portion and comprising first and second exhaust ports disposed on a same side wall portion of the housing. The first and second exhaust ports are configured to discharge air which has been taken into the housing and has passed through the image forming portion. The partition wall portion is provided so as to project from the side wall portion and configured to separate an outside space, facing the first exhaust port and to which the air discharged out of the first exhaust port is discharged, of the housing from an outside space, facing the second exhaust port and to which the air is discharged out of the second exhaust port, of the housing.

15 Claims, 6 Drawing Sheets

AIR EXHAUSTS AND IMAGE FORMING APPARATUS COMPRISING THE SAME

BACKGROUND OF THE INVENTION

Field of the Invention

The present invention relates to an image forming apparatus using electro-photographic technology such as a printer, a copier, a facsimile machine and a multi-function printer.

Description of the Related Art

While an image forming apparatus is configured to form an image by driving an image forming portion including a photo-sensitive a drum, a developing sleeve and others and various devices such as a fixing unit, these units possibly generate heat during their drive. Then, in order to prevent erroneous operation of the units caused by an increase of temperature and heat within the apparatus due to the heat generated by the units, an apparatus disclosed in Japanese Patent Application Laid-open No. 2013-3459 for example is configured to take air into the apparatus from an intake port and to forcibly discharge the air within the apparatus from an exhaust port.

However, because the image forming apparatus is often installed at a position close a user of the image forming apparatus, and if the air containing heat and discharged out of the exhaust port (referred to also as exhaust air hereinafter) hits the user, the user may feel uncomfortable. Then, the exhaust port is provided on a back surface opposite from a front surface where an operation panel of the apparatus operated by the user is provided such that the back surface where the exhaust port is provided faces a wall or a partition when the apparatus is installed. This arrangement makes it possible to prevent the exhaust air from hitting the user.

By the way, while it is preferable to install the image forming apparatus such that a certain clearance is kept between the apparatus and the wall in order to assure a path (exhaust path) through which air discharged out of the exhaust port flows, the apparatus is actually installed against the wall as close as possible due to an installation space or an installation layout. However, if the apparatus is installed too closely to the wall, the wall may obstruct the discharge of the air out of the exhaust port. Then, in order not to install the apparatus too closely to the wall, it is conceivable to provide a projecting member that comes into contact with the wall on the back surface of the apparatus to assure a clearance.

However, in a case of a configuration in which the air within the apparatus is discharged out of a plurality of exhaust ports, the air discharged out of either one exhaust port among the plurality of exhaust ports may obstruct air discharged out of other exhaust ports even if the projecting member is provided on the back surface of the apparatus. This problem is remarkable especially when quantities of airflows discharged respectively out of the plurality of exhaust ports are different. That is, if the exhaust air whose quantity is large hits against the wall, the exhaust air flows along the wall and is apt to block the other exhaust ports and to obstruct the discharge of air whose quantity is small.

In view of the problem described above, the present disclosure provides an image forming apparatus arranged such that no discharge of air out of each exhaust port is obstructed even if the image forming apparatus configured such that air within the apparatus is discharged out of a plurality of exhaust ports is installed such that a side on which the exhaust ports are provided faces against a wall or the like.

SUMMARY OF THE INVENTION

According to one aspect of the present invention, an image forming apparatus includes an image forming portion, a housing configured to store the image forming portion and comprising first and second exhaust ports disposed on a same side wall portion of the housing, the first and second exhaust ports being configured to discharge air which has been taken into the housing and has passed through the image forming portion, and a partition wall portion provided so as to project from the side wall portion and configured to separate an outside space, facing the first exhaust port and to which the air discharged out of the first exhaust port is discharged, of the housing from an outside space, facing the second exhaust port and to which the air is discharged out of the second exhaust port, of the housing.

Further features of the present invention will become apparent from the following description of exemplary embodiments with reference to the attached drawings.

DESCRIPTION OF THE EMBODIMENTS

First Embodiment

Figure 1:
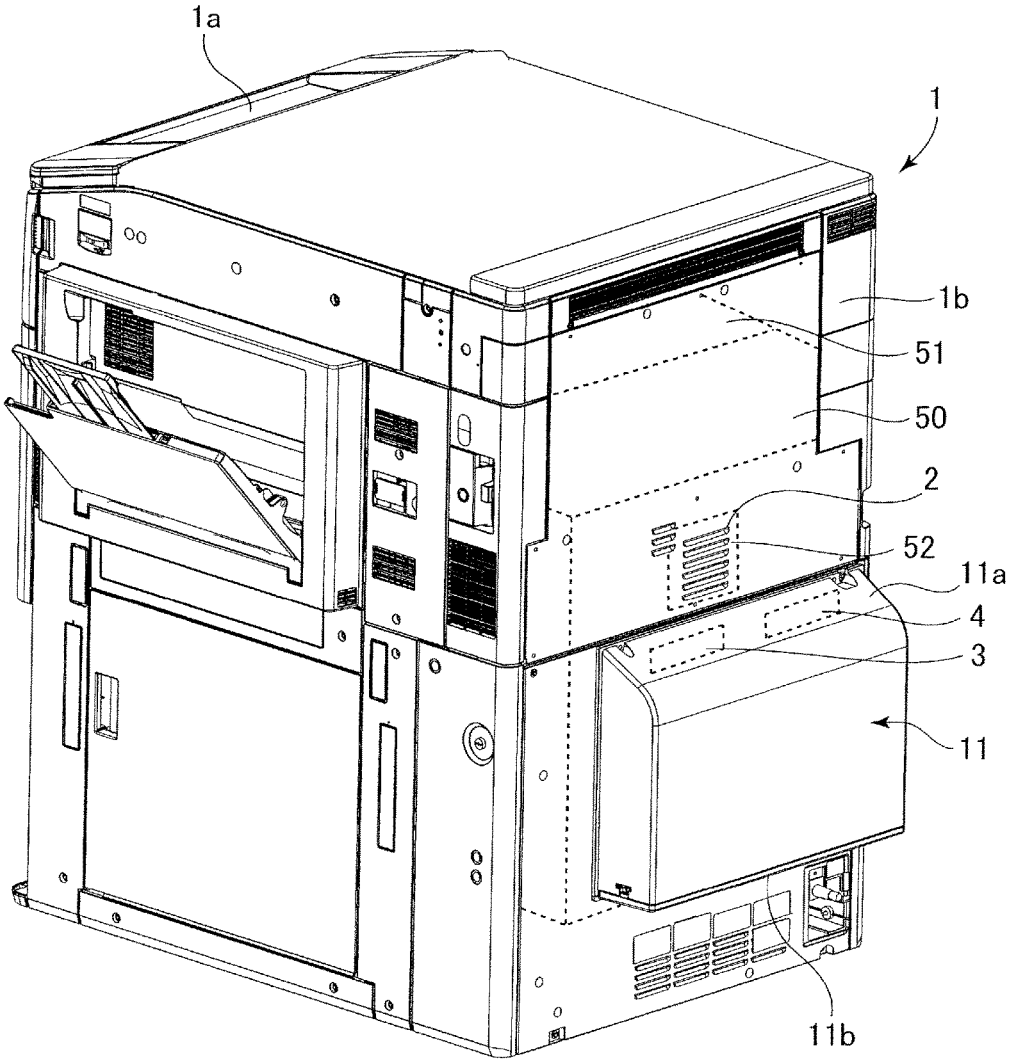
FIG. 1 is a perspective view illustrating an appearance of an image forming apparatus of a first embodiment.
Figure 2:
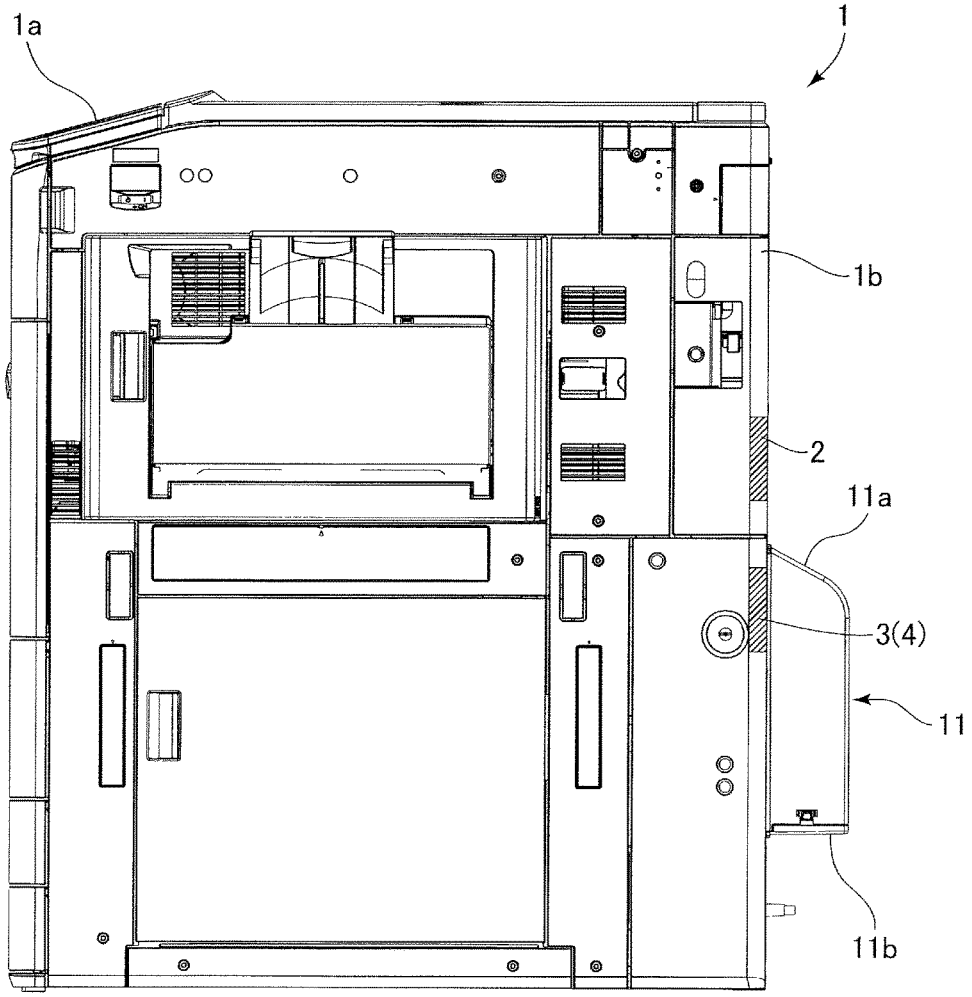
FIG. 2 is a side view of the image forming apparatus of the first embodiment.

An image forming apparatus of a first embodiment will be described with reference to FIGS. 1 through 3. The image forming apparatus illustrated in FIGS. 1 and 2 is an apparatus using electro-photographic technology such as a copier, a printer, a facsimile machine, various printing machines and a multi-function printer. The image forming apparatus includes, within a housing 1 thereof, an image forming portion 50 configured to form a toner image onto a recording member, a fixing unit 51 configured to fix the toner image onto the recording member by heating the toner image formed on the recording member, an electric board 52 configured to electrically control the image forming portion 50, the fixing unit 51 and others. Since these components are known, their description will be omitted here.

As illustrated in FIGS. 1 and 2, the housing 1 is provided with an operation panel 1*a* including a display, input keys and others. The image forming apparatus of the present embodiment is configured to execute an image forming operation of forming an image on the recording member corresponding to an operation made by a user through the operation panel 1*a*. It is noted that a side on which the operation panel 1*a* is provided will be referred to as a front side in this specification.

Discharge Port

The image forming apparatus includes a plurality of exhaust ports 2 through 4 in order to discharge air within the housing 1 out of the apparatus. These exhaust ports 2 through 4 are defined by a same side wall portion 1*b* on a back surface opposite from the front side of the housing 1 on which the operation panel 1*a* is provided. In a case of the present embodiment, the exhaust ports 3 and 4 are provided under the exhaust port 2 at positions in proximity to the exhaust port 2. Because the exhaust ports 2 through 4 are in proximity to each other, the exhaust airflows are apt to be influenced with each other unless an exhaust duct 11 described later is provided. It is noted that intake ports, not illustrated, for taking air into the housing 1 are provided on the front and side surfaces of the housing 1.

The plurality of exhaust ports 2 through 4 is provided in order to correspond to air passages within the housing 1. The air passages within the housing 1 may be roughly divided into a first air course for discharging air around the electric board 52 including electronic components, a second air course for discharging air around the image forming portion 50, and a third air course for discharging air around the fixing unit 51.

In the present embodiment, the exhaust ports 2 through 4 are provided such that the exhaust port 2 corresponds to the first air course as a first exhaust port, the exhaust port 3 corresponds to the second air course as a second exhaust port, and the exhaust port 4 corresponds to the third air course as a third exhaust port, respectively. Then, according to the present embodiment, the housing 1 is arranged such that air discharged out of the exhaust ports 2 through 4 are discharged in a same direction, i.e., such that the air within the housing 1 is discharged in a predetermined discharge direction, which is orthogonal to the side wall portion lb. It is noted that quantities of the air discharged out of the exhaust ports 3 and 4 are respectively greater than a quantity of the air discharged out of the exhaust port 2.

Exhaust duct

The image forming apparatus of the present embodiment is provided with the exhaust duct 11. As illustrated in FIGS. 1 and 2, the exhaust duct 11 is provided such that the exhaust duct 11 projects outside from the side wall portion 1*b* where the exhaust ports 2 through 4 are provided by a predetermined projection amount. The image forming apparatus is installed such that the side wall portion 1*b* provided with the exhaust duct 11 faces against a wall or a partition. It is because the user may feel uncomfortable if the air discharged out of the exhaust ports 2 through 4 and containing heat hits the user operating the operation panel 1*a*. Because one surface of the exhaust duct 11 comes into contact with the wall when the image forming apparatus is installed in the present embodiment, it is possible to assure an enough clearance between the side wall portion 1*b* and the wall through which the air discharged out of the exhaust port 2 flows along the wall. The projection amount of the exhaust duct 11 from the side wall portion 1*b* is so determined to achieve this end. Thus, the exhaust duct 11 has a function of assuring the discharge passage of the air discharged out of the exhaust port 2.

Figure 3:
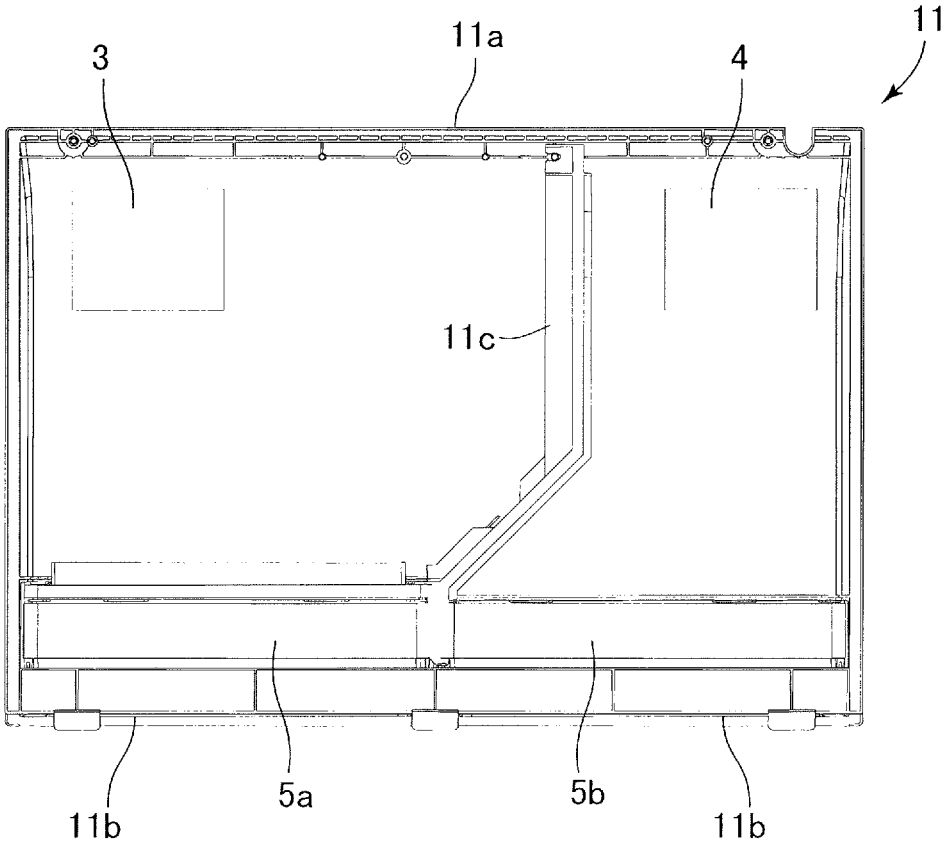
FIG. 3 is a section view illustrating an exhaust duct.

As illustrated in FIGS. 1 and 3, the exhaust duct 11 is provided so as to cover the exhaust ports 3 and 4 such that the air discharged out of the exhaust ports 3 and 4 in the discharge direction orthogonal to the side wall portion 1*b* is discharged in a direction different from the discharge direction. In the case of the present embodiment, the exhaust duct 11 is formed cylindrically by resin or the like such that the exhaust duct 11 extends from the exhaust ports 3 and 4 vertically downward along the side wall portion 1*b*. Then, a distal end portion of the exhaust duct 11 on an output side opposite on an input side from which the exhaust air is taken in from the exhaust ports 3 and 4 is defined to be an opening portion 11*b*. Therefore, the air discharged out of the exhaust ports 3 and 4 is discharged downward from the opening portion 11*b* by passing through the exhaust duct 11 without hitting against the wall. Thus, the exhaust duct 11 has a function of changing the discharge direction of the air discharged out of the exhaust ports 3 and 4 in the different direction.

Filter

The air discharged out of the exhaust ports 3 and 4 is filtered in the image forming apparatus of the present embodiment, and the exhaust duct 11 is provided with a filter. As illustrated in FIG. 3, an inside of the exhaust duct 11 is divided into two chambers by a partition member 11*c*. A first filter 5*a* is set in one of the chambers and a second filter 5*b*, different from the first filter 5*a*, is set in the other chamber.

It is possible to increase filtration performance of the filters 5*a* and 5*b* by increasing sizes of the filters 5*a* and 5*b* in general. It is also possible to increase the filtration performance by slowing down a speed (air speed) of the air passing through the filters 5*a* and 5*b* by enlarging a cross-sectional area of the air courses through which the air within the exhaust duct 11 passes and by prolonging the air courses. Then, the filters 5*a* and 5*b* are enlarged, the cross-sectional areas of the air courses, i.e., the second and third air courses, are enlarged and lengths of the air courses are assured by projecting the exhaust duct 11 from the side wall portion 1*b* and by disposing the filters 5*a* and 5*b* at positions close to the opening portion 11*b*.

Partition Wall

As illustrated in FIGS. 1 and 2, the exhaust duct 11 described above covers the exhaust ports 3 and 4 so as to separate the exhaust port 2 from the exhaust ports 3 and 4 in the present embodiment. The exhaust duct 11 includes a partition wall portion 11*a* formed so as to project from the side wall portion 1*b* and to separate the exhaust port 2 from the exhaust ports 3 and 4. In other words, the partition wall portion 11*a* projects from the side wall portion 1*b* so as to separate the exhaust port 2 from the exhaust ports 3 and 4 and constitutes a part of the exhaust duct 11.

If there is no exhaust duct 11, or more specifically there is no partition wall portion 11*a*, the air discharged out of the exhaust ports 3 and 4 hits against the wall and flows so as to spread in four directions. Among them, an upward airflow may block the exhaust port 2, thus obstructing the discharge of the air out of the exhaust port 2.

In contrast, because the air discharged out of the exhaust ports 3 and 4, does not hit against the wall and spread in the four direction due to the partition wall portion 11*a* in the present embodiment, the air discharged out of the exhaust ports 3 and 4 will not block the exhaust port 2. That is, the air discharged out of the exhaust ports 3 and 4 will not obstruct the discharge of the air out of the exhaust port 2. In terms of also the air discharged out of the exhaust port 2 and hitting against the wall, the partition wall portion 11*a* will block the flow of the air such that the air will not flow to the side of the exhaust ports 3 and 4.

It is noted that because the partition member 11*c* is provided within the exhaust duct 11 as described above, the air discharged out of the exhaust port 3 will not obstruct the discharge of the air out of the exhaust port 4 and the air discharged out of the exhaust port 4 will not obstruct the discharge of the air out of the exhaust port 3.

As described above, according to the image forming apparatus of the present embodiment, the exhaust port 2 is separated from the exhaust ports 3 and 4 by the exhaust duct 11 which is partially composed of the partition wall portion 11*a* and covering the exhaust ports 3 and 4. Thereby, the air discharged out of the exhaust ports 3 and 4 is discharged out of the opening portion 11*b* through the exhaust duct 11 without hitting against the wall. That is, because the air discharged out of the exhaust ports 3 and 4 will not spread by hitting against the wall, the discharge of the air out of the exhaust port 2 is not obstructed by the air discharged out of the exhaust ports 3 and 4. Still further, because the exhaust duct 11 projects from the side wall portion 1*b* through which the exhaust ports 2 through 4 are defined, the exhaust duct 11 assures an enough clearance between the side wall portion 1*b* and the wall through which the air discharged out of the exhaust port 2 flows along the wall. Accordingly, even if the apparatus is installed such that the side wall portion 1*b* through which the plurality of exhaust ports 2 through 4 are defined faces the wall or the like, the discharge of the air out of the respective exhaust ports 2 through 4 is hardly obstructed.

Second Embodiment

Figure 4:
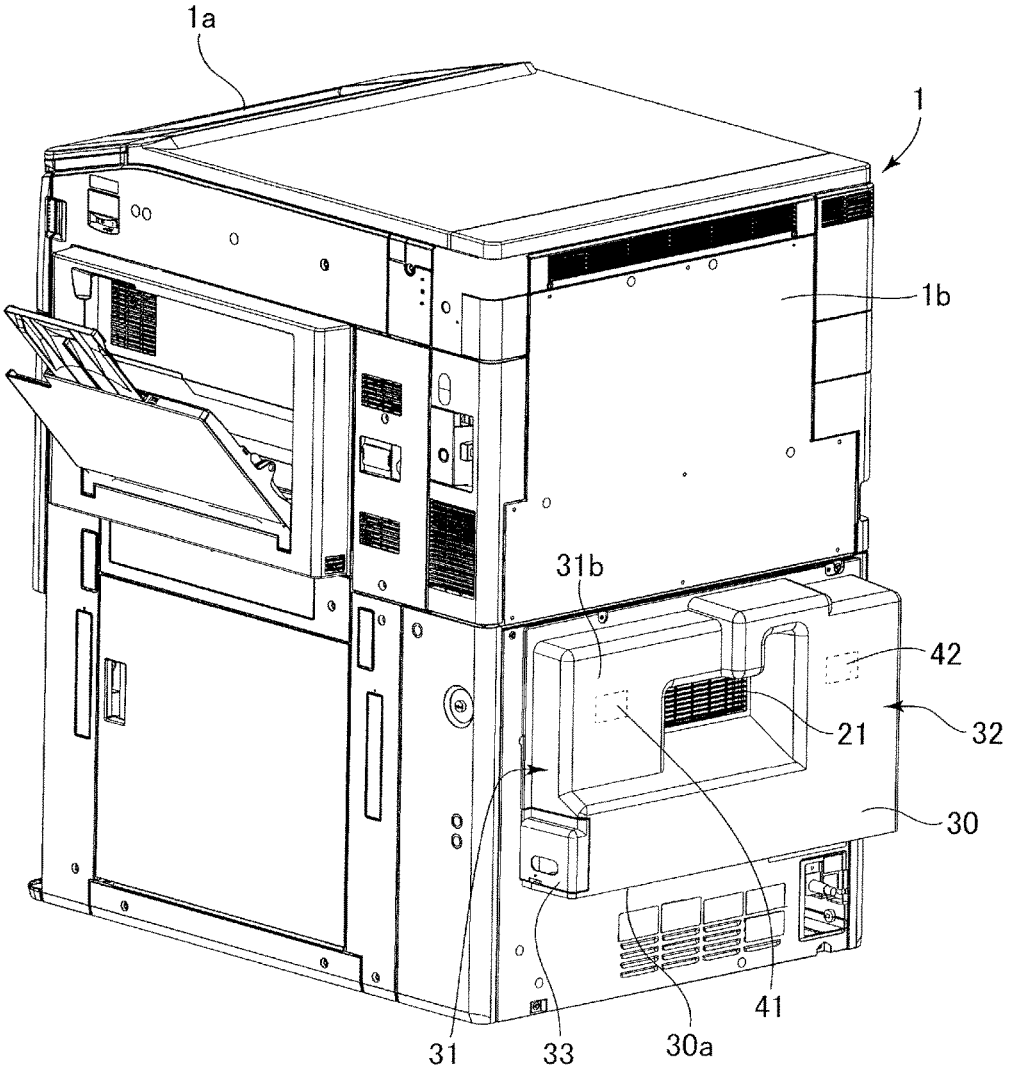
FIG. 4 is a perspective view illustrating an appearance of an image forming apparatus of a second embodiment.
Figure 5:
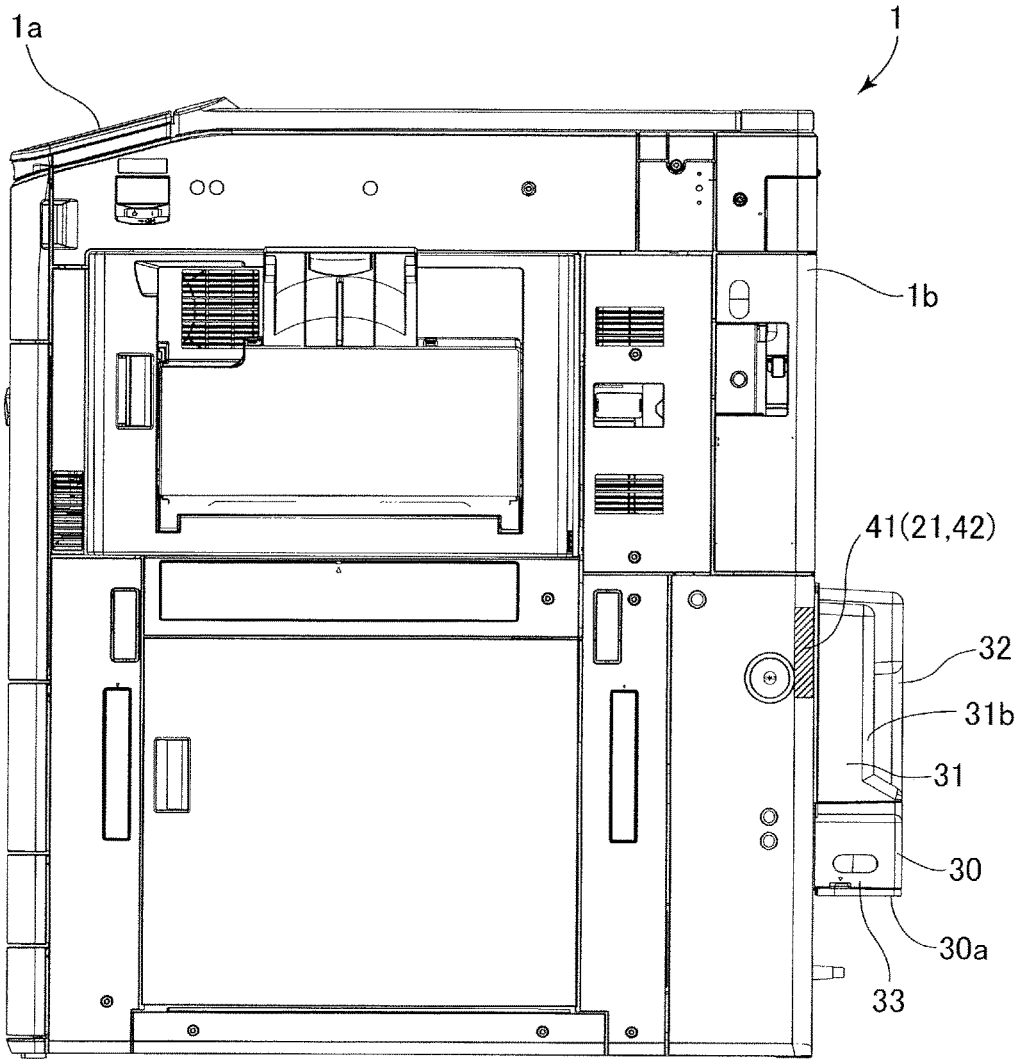
FIG. 5 is a side view of the image forming apparatus of the second embodiment.

An image forming apparatus of a second embodiment will be described with reference to FIGS. 4 and 5. As illustrated in FIG. 4, the image forming apparatus of the second embodiment includes a plurality of exhaust ports 21, 41 and 42 to discharge air within the housing 1 out of the apparatus. Similarly to the first embodiment described above, these exhaust ports 21, 41 and 42 are defined through the same side wall portion 1*b* of the back surface opposite to the front side of the housing 1 on which the operation panel la is provided. In a case of the present embodiment however, the exhaust ports 41 and 42 are arrayed approximately right aside the exhaust port 21. The exhaust ports 21, 41 and 42 are defined such that the exhaust port 21 corresponds to the first air course described above as a first exhaust port, the exhaust port 41 corresponds to the second air course as a second exhaust port, and the exhaust port 42 corresponds to the third air course as a third exhaust port, respectively. It is noted that in the case of the present embodiment, air within the housing 1 is discharged out of the respective exhaust ports 21, 41 and 42 in a predetermined discharge direction orthogonal to the side wall portion 1*b* . Still further, quantities of air discharged out of the exhaust ports 41 and 42 is greater than a quantity of air discharged out of the exhaust port 21.

Exhaust Duct

The image forming apparatus of the second embodiment includes a first exhaust duct 31 and a second exhaust duct 32, i.e., a different exhaust duct. These first and second exhaust ducts 31 and 32 may be formed in a body or separately. As illustrated in FIG. 4, the first exhaust duct 31 is provided so as to cover the exhaust port 41 such that the air discharged out of the exhaust port 41 in the discharge direction orthogonal to the side wall portion 1*b* is discharged in a direction different from the discharge direction. Meanwhile, the second exhaust duct 32 is provided so as to cover the exhaust port 42 such that the air discharged out of the exhaust port 42 in the discharge direction orthogonal to the side wall portion 1*b* are respectively discharged in a direction different from the discharge direction.

Exhaust Air Passing Portion

The first and second exhaust ducts 31 and 32 are formed cylindrically so as to extend from the exhaust port 41 or the exhaust port 42 vertically downward along the side wall portion 1*b*. Then, the first and second exhaust ducts 31 and 32 include an exhaust air passing portion 30 configured to pass the air discharged out of the respective exhaust ducts on a side opposite from an intake side from which the exhaust air of the exhaust ports 41 and 42 are taken in. The exhaust air passing portion 30 includes an opening portion 30*a* such that the air discharged out of the exhaust ports 41 and 42 is discharged downward from the exhaust air passing portion 30 by passing respectively through the first and second exhaust ducts 31 and 32.

The exhaust air passing portion 30 is provided with a first filter not illustrated and filtering the air discharged out of the exhaust ports 41 and 42 and a second filter not illustrated and different from the first filter. These filters are stored in a filter storing portion 33 which is removably attached to the exhaust air passing portion 30. This arrangement makes it possible to collectively replace the first and second filters not illustrated.

As illustrated in FIG. 4, the first and second exhaust ducts 31 and 32 including the exhaust air passing portion 30 are disposed so as to surround the exhaust port 21 in the present embodiment. While the first and second exhaust ducts 31 and 32 project outside from the side wall portion 1*b* on which the exhaust ports 21, 41 and 42 are defined by a predetermined projection amount, the first exhaust duct 31 is provided with a concave portion 31*b* formed such that a projection amount from the side wall portion 1*b* is smaller than other parts of the first and second exhaust ducts 31 and 32.

According to the present embodiment, if the image forming apparatus is installed such that the side wall portion 1*b* on which the first and second exhaust ducts 31 and 32 are provided faces against a wall or a partition, one surface of the second exhaust duct 32 including the exhaust air passing portion 30 comes into contact with the wall. Meanwhile, the first exhaust duct 31 comes into contact with the wall at a position other than the concave portion 31*b* and does not come into contact with the wall at a position corresponding to the concave portion 31*b*. That is, the concave portion 31*b* assures an enough clearance through which the air discharged out of the exhaust port 21 flows along the wall between the side wall portion 1*b* and the wall. The projection amounts from the side wall portion 1*b* of the first and second exhaust ducts 31 and 32 and of the concave portion 31*b* are determined to achieve that end.

According to the present embodiment, if the image forming apparatus is installed such that the side wall portion 1*b* on which the first and second exhaust ducts 31 and 32 are provided faces against a wall or a partition, one surface of the second exhaust duct 32 including the exhaust air passing portion 30 comes into contact with the wall. Meanwhile, the first exhaust duct 31 comes into contact with the wall at a position other than the concave portion 31*b* and does not come into contact with the wall at a position corresponding to the concave portion 31*b*. That is, the concave portion 31*b* assures an enough clearance through which the air discharged out of the exhaust port 21 flows along the wall between the side wall portion 1*b* and the wall. The projection amounts from the side wall portion 1*b* of the first and second exhaust ducts 31 and 32 and of the concave portion 31*b* are determined to achieve that end.

In the case of the present embodiment, the air discharged out of the exhaust ports 41 and 42 does not hit against the wall nor spread in the four directions, the exhaust port 21 is not blocked by the air discharged out of the exhaust ports 41 and 42. Then, a flow of the air discharged out of the exhaust port 21 and hitting against the wall is regulated so as to pass the clearance between the wall and the first exhaust duct 31 assured by the concave portion 31*b*. It is noted that the concave portion 31*b* may be formed at least a part of either one of the first and second exhaust ducts 31 and 32, and a direction in which the air discharged out of the exhaust port 21 flows may be set at an arbitrary direction depending on a position of the concave portion 31*b*.

As described above, it is possible to obtain the similar advantageous effects with the first embodiment described above also by the image forming apparatus of the second embodiment. That is, the exhaust port 21 is separated from the exhaust ports 41 and 42 by covering the exhaust ports 41 and 42 by the first and second exhaust ducts 31 and 32. Thereby, the air discharged out of the exhaust ports 41 and 42 is discharged out of the exhaust air passing portion 30 by passing through the first and second exhaust ducts 31 and 32 without hitting against the wall. That is, because the air discharged out of the exhaust ports 41 and 42 does not hit against the wall nor spread in the four directions, the discharged air out of the exhaust port 21 is not obstructed by the air discharged out of the exhaust ports 41 and 42. Still further, it is possible to assure the enough clearance between the side wall portion 1*b* and the wall through which the air discharged out of the exhaust port 21 flows along the wall by forming the concave portion 31*b*. Accordingly, even if the image forming apparatus is installed such that the side wall portion 1*b* on which the plurality of exhaust ports 21, 41 and are provided faces against the wall or the like, the discharge of the air flows from the respective exhaust ports 21, 41 and 42 are hardly obstructed.

Other Embodiment

Figure 6:
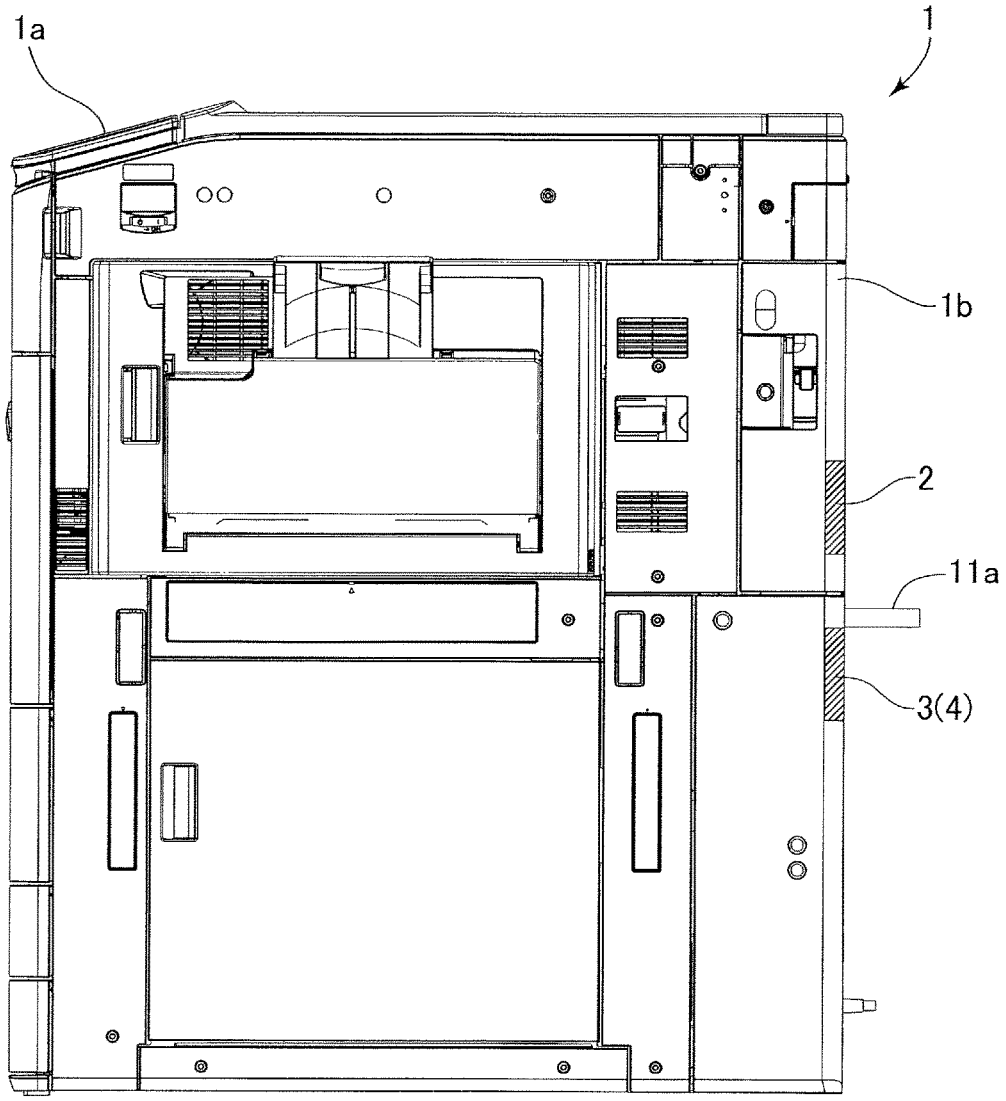
FIG. 6 is a side view illustrating an image forming apparatus of another embodiment.

It is noted that while the case in which the exhaust duct 11 is provided with the partition wall portion 11*a* has been described in the first embodiment described above, the present disclosure is not limited to such configuration. For instance, as illustrated in FIG. 6, only the partition wall portion 11*a* may be provided so as to project from the side wall portion 1*b* and to separate the exhaust port 2 from the exhaust ports 3 and 4. However, in view of the point that the filter 5 (see FIG. 3) is disposed to filter the discharged air as described above, it is preferable to form the partition wall portion 11*a* so as to constitute a part of the exhaust duct 11.

It is also noted that while the cases in which the exhaust ducts and the exhaust ports are provided on the back surface of the image forming apparatus have been described in the respective embodiments described above, the present disclosure is not limited to such configurations, and the exhaust ducts and the exhaust ports may be provided on a side surface of the image forming apparatus.

It is also noted that the cases in which the exhaust ducts discharge the air downward have been described in the respective embodiments described above, the present disclosure is not limited to such configuration. For instance, in the case of the first embodiment, the exhaust duct 11 may be arranged so as to discharge the air toward the side of the apparatus. In the case of the second embodiment, the first and second exhaust ducts 31 and 32 may be arranged so as to discharge the air toward the side or above the apparatus.

As described above, according to the present disclosure, the partition wall portion projecting from the side wall portion so as to separate the first exhaust port from the second exhaust port blocks the air which has been taken in, passed through the image forming portion and discharged out of one exhaust port from flowing toward the other exhaust port of the air which has been taken in and passed through the image forming portion. Thereby, even if the image forming apparatus is installed such that the side wall portion through which the first and second exhaust ports are defined faces against the wall or the like, the air within the apparatus is discharged out of the apparatus through the plurality of exhaust ports without being obstructed by such simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-101577, filed May 20, 2016, which is hereby incorporated by reference herein in its entirety.

What is claimed is:

1. An image forming apparatus, comprising:

an image forming portion;

an outer casing in which the image forming portion is provided, the outer casing including:

a first exhaust opening provided on a back surface of the outer casing and configured to discharge an air, taken into the outer casing and passing through a first ventilation path formed in the outer casing, from the back surface; and a second exhaust opening provided on the back surface of the outer casing and configured to discharge an air, taken into the outer casing and passing through a second ventilation path formed in the outer casing, from the back surface; and a guide cover configured to cover the second exhaust opening in such a manner that the first exhaust opening is not covered and the air discharged out of the second exhaust opening is guided toward a space other than a space facing the first exhaust opening, wherein at least a portion of the guide cover is aligned with at least a portion of the first exhaust opening in a vertical direction and the guide cover is positioned backward of the first exhaust opening.

2. The image forming apparatus according to claim 1, wherein the guide cover includes a filter for filtering the air discharged out of the second exhaust opening.

3. The image forming apparatus according to claim 1, further comprising an electric board provided on the way of the first ventilation path, wherein the first exhaust opening discharges the air passing around the electric board.

4. The image forming apparatus according to claim 1, wherein the image forming portion is provided on the way of the second ventilation path, and the second exhaust opening discharges air passing around the image forming portion.

5. The image forming apparatus according to claim 1, wherein the guide cover is formed separately from the outer casing and attached to the back surface of the outer casing.

6. The image forming apparatus according to claim 1, wherein the guide cover is an exhaust duct comprising a intake configured to take in the air discharged out of the second exhaust opening and an outlet configured to discharge the air, taken from the intake, out of the guide cover.

7. The image forming apparatus according to claim 6, wherein the exhaust duct disposed around the first exhaust opening so as to surround the first exhaust opening, wherein the exhaust duct includes a concave portion whose projection amount from the back surface of the outer casing is smaller than that of other part of the exhaust duct.

8. The image forming apparatus according to claim 1, wherein a quantity of the air discharged out of the second exhaust opening is greater than a quantity of the air discharged out of the first exhaust opening.

9. The image forming apparatus according to claim 1, wherein the guide cover guides the air discharged out of the second exhaust opening vertically downward.

10. The image forming apparatus according to claim 1, further comprising a fixing unit disposed on the way of a third ventilation path which is provided in the outer casing, wherein the outer casing comprises a third exhaust opening provided on the back surface of the outer casing and configured to discharge an air passing around the fixing unit through the third ventilation path.

11. The image forming apparatus according to claim 10, wherein a quantity of the air discharged out of the third exhaust opening is greater than a quantity of the air discharged out of the first exhaust opening.

12. The image forming apparatus according to claim 10, wherein the guide cover is configured to cover the second and third exhaust openings and both of the air discharged out of the second exhaust opening and the air discharged out of the third exhaust opening are filtered by a filter.

13. An image forming apparatus, comprising:

an image forming portion;

an outer casing in which the image forming portion is provided, the outer casing including:

a first exhaust opening provided on a back surface of the outer casing and configured to discharge an air, taken into the outer casing and passing through a first ventilation path formed in the outer casing, from the back surface; and a second exhaust opening provided on the back surface of the outer casing and configured to discharge an air, taken into the outer casing and passing through a second ventilation path formed in the outer casing, from the back surface; and an exhaust duct configured to cover the second exhaust opening and disposed around the first exhaust opening so as to surround the first exhaust opening, the exhaust duct comprising a concave portion through which the air discharged out of the first exhaust opening passes.

14. The image forming apparatus according to claim 13, wherein the outer casing comprises a third exhaust opening provided on the back surface of the outer casing and configured to discharge an air, taken into the outer casing and passing through a third ventilation path formed in the outer casing, from the back surface, and the exhaust duct covers both of the second exhaust opening and the third exhaust opening.

15. An image forming apparatus, comprising:

an image forming portion;

an outer casing in which the image forming portion is provided, the outer casing including:

a first exhaust opening provided on a back surface of the outer casing and configured to discharge an air, taken into the outer casing and passing through a first ventilation path formed in the outer casing, from the back surface; and a second exhaust opening provided below the first exhaust opening on the back surface of the outer casing and configured to discharge an air, taken into the outer casing and passing through a second ventilation path formed in the outer casing, from the back surface; and a third exhaust opening provided below the first exhaust opening on the back surface of the outer casing and configured to discharge an air, taken into the outer casing and passing through a third ventilation path formed in the outer casing, from the back surface, an exhaust duct configured to cover the second and third exhaust openings and configured to guide both of the air discharged out of the second exhaust opening and the air discharged out of the third exhaust opening vertically downward.

* * * * *